US005531065A

United States Patent [19]

Rozenwasser

[11] Patent Number: 5,531,065

[45] **Date of Patent: *Jul. 2, 1996**

[54] FINE JEWELRY DIAMOND CUT ROPE CHAIN AND METHOD OF MANUFACTURE THEREOF

[75] Inventor: David Rozenwasser, Savion, Israel

[73] Assignee: Avraham M. Rozenwasser, Savion, Israel

[ * ] Notice: The term of this patent shall not extend beyond the expiration date of Pat. No. 5,303,540.

[21] Appl. No.: 238,828

[22] Filed: May 6, 1994

[30] Foreign Application Priority Data

| | | | |
|---|---|---|---|
| Oct. 1, 1992 | [IL] | Israel | 103324 |
| Jul. 1, 1993 | [IL] | Israel | 106201 |

[51] Int. Cl.[6] ..... B21L 5/02

[52] U.S. Cl. ..... 59/80; 59/35.1; 59/82

[58] Field of Search ..... 59/80, 82, 35.1

[56] References Cited

U.S. PATENT DOCUMENTS

| | | | |
|---|---|---|---|
| D. 326,065 | 5/1992 | Borgogni . | |
| 5,303,540 | 4/1994 | Rozenwasser | 59/80 |
| 5,412,935 | 5/1995 | Rozenwasser | 59/80 |
| 5,425,228 | 6/1995 | Hillel | 59/80 |

*Primary Examiner*—David Jones

[57] ABSTRACT

A fine jewelry diamond cut rope chain comprising a double helix rope chain made from tightly interfitting links of precious metal link wire, each link having a small gap formed therein so as to enable one of said links to pass through the gap of another link, said links being intertwined to fit tightly one against another, at least some of the links of the chain having a shallow high luster diamond cut surface band extending on the outer surface of at least part of an outer perimeter of said link, the cross-section of the link wire being substantially of the same shape throughout.

22 Claims, 7 Drawing Sheets

FINE JEWELRY DIAMOND CUT ROPE CHAIN AND METHOD OF MANUFACTURE THEREOF

FIELD OF THE INVENTION

The present invention relates to novel fine jewelry diamond cut rope chains and to methods of manufacturing them. Specifically the invention is concerned with novel hollow diamond cut rope chains.

BACKGROUND OF THE INVENTION

Fine jewelry rope chains for necklaces and bracelets etc. have been known for a long time. The traditional rope chain, constructed from intertwined links soldered to one another has not changed basically over the past hundreds of years. Although rope chains are also manufactured by automatic machines, the tightly intertwined chains are still being manufactured to a great extent by hand. In my earlier patents U.S. Pat. Nos. 4,934,135 and 4,996,835, I disclosed and claimed rope chains and methods for preparing such rope chains having reduced weight and labour costs compared with conventional rope chains of the same chain diameter.

A particularly popular type of rope chain is commonly known as a diamond cut rope chain. Such a chain comprises flat cuts or facets on the outer perimeter of at least some of the chain links to provide a flat mirror finish surface which is very light reflective, making the chain sparkle. This diamond cut facet can easily be prepared on solid rope chains, i.e. chains made with solid links, by cutting or shaving a facet from the arced section of the link, as is well known in the art.

Conventional solid diamond cut (faceted) rope chains have facets generally cut about one third or more into the thickness of the chain link in order to obtain a reasonable size shiny surface, as illustrated in FIG. 1. The amount of precious metal sheared away to form this facet can account for up to 10% of the weight of the chain and although the metal shearings are collected and recycled, a significant amount of precious metal is nevertheless lost in the process. In the case of hollow rope chains, i.e. chains having hollow links, it is difficult to make diamond cut facets in the conventional way, since the outer plate of the hollow wire making up the chain link is very thin and can be as little as 0.05 mm thick, and any facet cut in the outer arced perimeter of the link would make a hole through this outer plate.

A recent patent to Strobel, U.S. Pat. No. 5,125,225, discusses the making of rope chains in general and hollow rope chains specifically and claims a method for manufacturing diamond cut hollow rope chains by wrapping a hollow rope chain about a lathe drum, freezing the drum, applying water to the chain to freeze it in place thereby immobilising it, and advancing a blunt burnishing tool against the links of the chain by applying a plurality of incremental deformative thrusts of blunt force against some of the curved outer wall portions of the hollow links until this outer wall is deformed and pushed back towards the inner wall of the links, thus flattening portions of the curved outer wall. By rotating the lathe drum and advancing the blunt burnishing tool, additional links along the chain length receive flattened surfaces. According to this method, not all of the chain links have identical flattened area. The amount of flattened area of any link will depend on the particular position of the link in the chain when the blunt burnishing tool strikes it. Those links whose outer edge is closer to the blunt tool will have a larger flattened area, whereas the links that are further away from the blunt tool receive smaller increments of force and will therefore have smaller flattened areas. These flattened portions of the outer walls are then diamond cut to remove or shave off a very thin layer of metal (about 0.001 to 0.002 mm) to provide smooth and shiny facets without making any hole in the link. According to this patent, the hollow link undergoing the flattening process has one flat oval facet positioned approximately opposite the link gap, as illustrated in FIG. 5 of said patent, similar to conventional diamond cut solid rope chains shown in FIG. 1. The cross-section of the faceted area is obviously deformed with respect to the cross-section of the rest of the chain link.

Another recent patent, U.S. Pat. No. 5,285,625, claims rope chains having one facet extending spirally around the longitudinal center of the chain, wherein the one facet is defined by sub-facets on successively located links, said sub-facets lying in different spatially oriented planes. The sub-facets, according to this patent, are deformations on the chain links, i.e. the faceted area has a substantially different wire cross-section than the rest of the link. As illustrated in FIG. 11*a* of this patent, the facets having the reference numerals 36*a* and 36*b* are obtained in solid links, by substantially shaving or shearing a curved section of the link. In hollow links the facets are obtained by burnishing the links as taught in U.S. Pat. No. 5,125,225. This method produces flat depressed surfaces deforming the circumference of the link wire cross-section.

SUMMARY OF THE INVENTION

It is an object of the present invention to provide a novel fine jewelry diamond cut rope chain.

Another object of the invention is to provide a rope chain having high luster shallow diamond cut bands or strips on the outer circumference of the chain links.

Still another object is to provide rope chains with hollow links having high luster shallow diamond cut bands or strips on their outer circumference.

Yet another object is to provide methods of manufacturing such fine jewelry high luster diamond cut rope chains.

A further object is to provide precious metal chain links with shallow high luster diamond cut bands or strips on their outer circumference.

A still further object is to provide methods for manufacturing fine jewelry hollow chain links having high luster diamond cut bands or strips on their outer circumference without deformation of the hollow link wire.

These and other objects are obtained by the present invention wherein a diamond cut high luster finish is provided on a very shallow band or strip, having a depth of only about 1/100 of the link wire thickness, significantly reducing loss of metal shavings. Moreover, the diamond cuts follow the contour of the link wire and only affect the outer surface of the chain links, keeping the inner cross-section of the link wire substantially uniform.

In accordance with the present invention there is provided a fine jewelry diamond cut rope chain comprising a double helix rope chain made from tightly interfitting links of precious metal link wire, each link having a small gap formed therein so as to enable one of said links to pass through the gap of another link, said links being intertwined to fit tightly one against another, at least some of the links of the chain having a shallow high luster diamond cut surface band extending on the outer surface of at least part of an outer perimeter of said link, the cross-section of the link wire being substantially of the same shape throughout.

In a preferred embodiment, all the links of the chain comprise diamond cut high luster shallow surface bands or strips. In another preferred embodiment, the shallow diamond cut high luster surface band or strip extends along the width or length of the outer perimeter of each link. In a most preferred embodiment, the rope chain comprises hollow links.

In a preferred embodiment, the diamond cut rope chain of this invention may be assembled by machine or by hand using chain links already having diamond cut shallow surface bands or strips on the links.

Hollow links for making rope chains are generally prepared in the following manner. First, a hollow wire is prepared from a thin foil or plate of precious metal, for example gold, of indefinite length having a thickness of about 0.05–0.1 mm and a width slightly less than the outer circumference of the designated hollow wire cross-section. This is accomplished by drawing the length of the foil or plate through a die, for example a round die, together with a soft metal wire core, such as from copper or aluminum, so that the precious metal foil or plate wraps around the soft metal core as it is drawn through the die to form a tube. The cross-section of the wire will correspond to the shape of the orifice of the die. Since the width of the foil or plate is smaller than the circumference of the soft metal core, a longitudinal gap is formed along the entire length of the gold tube. From this gold plated wire containing the soft metal core, chain links are made in a conventional manner. The soft metal core is then dissolved with strong acid, which penetrates via the longitudinal gap, leaving hollow gold chain links. Alternatively, the links with the core still inside can be assembled into a rope chain and the cores dissolved subsequently by immersing the chain in suitable acid. "Seamless" hollow chain links are made in a similar manner but without a longitudinal gap in the gold plating. The "seamless" links are not as practical to use, since it is more difficult to dissolve the inner soft metal core because of the small surface area available for contacting the acid.

In accordance with one aspect of the present invention, a precious metal foil or plate is first shaved along its length with a high-speed rotating diamond cutting edge, forming a shallow high luster surface band or strip in the foil or plate. This foil or plate is subsequently made into a hollow wire as described hereinbefore with the shallow high luster surface band or strip facing outwards opposite the seam. Chain links are produced from this wire by any conventional means. Each of the chain links thus comprises a diamond cut shallow high luster surface band or strip contrasted against a less shiny outer perimeter of the link. The hollow wire inner cross-section remains the same throughout each link. The width of the shallow diamond cut surface band or strip can vary depending on the length of the cutting edge of the high speed rotating diamond cutting tool. The depth of the band or strip etched into the foil or plate may vary between 0.001–0.04 mm, but preferably between 0.005–0.03 mm, and most preferably between 0.01–0.03 mm. This, of course, will depend to a great extent on the thickness of the foil or plate. The specific depth is immaterial as long as the chain link wall is not deformed and retains sufficient strength so that it can be used in preparing hollow link rope chains. The depth of the band or strip in the precious metal plate is generally difficult to distinguish, if at all, with the human eye. Thus the band has no apparent visible deformation of the general geometry of the chain link. The shallow diamond cut appears like an etched surface.

Alternatively, the diamond cut shallow high luster surface band or strip can be shaved directly from the surface of a precious metal coated wire while it still contains the non-precious metal core, prior to its removal by dissolving with acid. This can be accomplished in several ways. One way is by pulling the precious metal wire past a high speed rotating diamond cutting head having a cutting edge contoured to conform with the outer perimeter of the precious metal wire. As the wire passes the diamond cutting edge, a very shallow high luster band or strip is shaved from the outer surface of the precious metal wire along its longitudinal axis having the same curvature as the wire perimeter. Another way of producing the shallow surface bands or strips is to coil the wire around a former of any designated shape and feed the coil past a diamond cutting knife edge or vice versa, moving the diamond cutting knife edge over a coiled wire, and shaving off a very thin band or strip on the surface of the coiled wire, leaving a section of high luster surface band or strip on the outer perimeter of the wire. The coiled wire can then be made into chain links in the conventional way. Chain links can be prepared from this diamond cut wire which may have high luster bands or strips along the entire outer circumference or only on sections thereof. It is also possible to have more than one shallow strip shaved or engraved on the outer surface of the circumference of the link, providing chains with links having one, two or more axial or radial high luster strips, giving different sparkling effects.

Rope chains made from links according to this invention have highly reflective shallow diamond cut surface bands or strips along their outer perimeter providing a contrasting sparkling fine jewelry chain. One advantage of the present invention is that the chains can be made without any appreciable additional manufacturing costs, since the only additional step beyond the conventional ones for preparing links is the diamond cutting step of the precious metal wire or plate, and this requires only conventional apparatus generally found in gold chain manufacturing enterprises.

BRIEF DESCRIPTION OF THE DRAWINGS

The invention will now be discussed with reference to the drawings, in which.

DETAILED DESCRIPTION OF THE INVENTION

Figure 1:
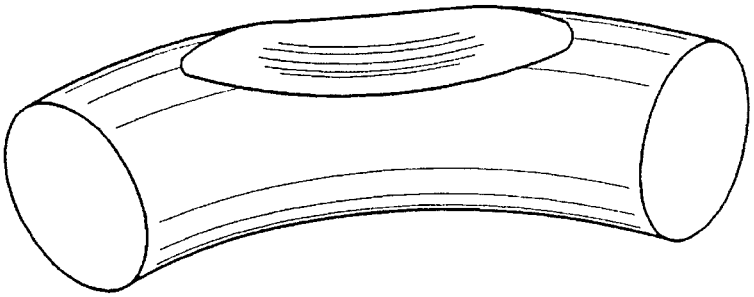
FIG.1 PRIOR ART
FIG. 1 illustrates a prior art chain link section with a diamond cut facet.
Figure 2A:
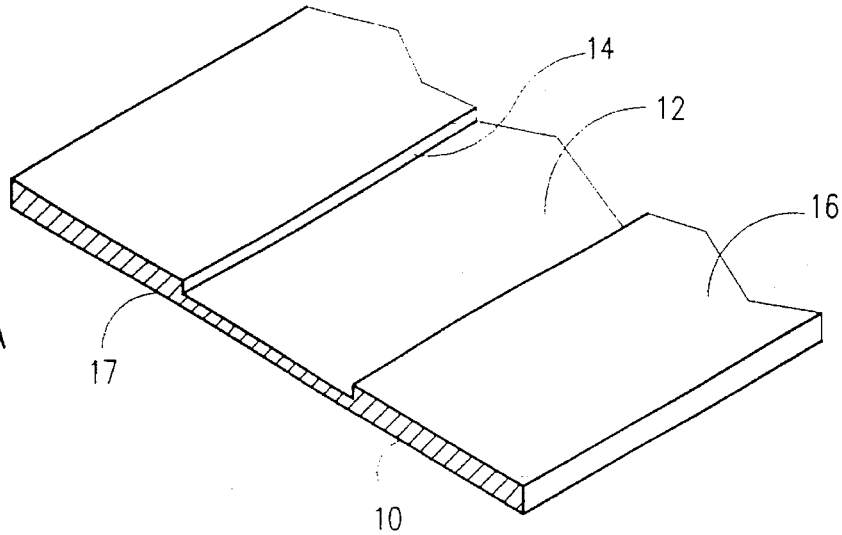
FIGS. 2A and 2B are enlarged perspective cross-sectional views of diamond cut precious metal foil from which hollow chain wire is made to provide links in accordance with this invention.
Figure 2B:
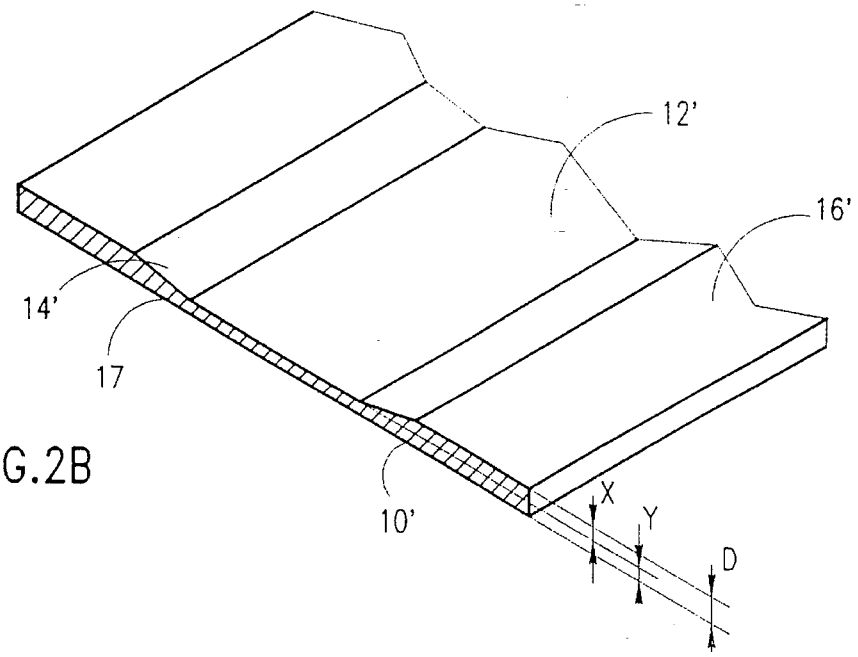

Referring now to FIGS. 2A and 2B, there are illustrated blown up perspective cross-sections of thin plates of precious metal 10 and 10' respectively, having diamond cut shallow bands 12 and 12' shaved along their axial length. The bands 12 and 12' are shaved by passing the plates under high speed rotating diamond cutting heads rotating at about 8,000 to 20,000 r.p.m to reduce the thickness of the sheet at this point from D to Y (FIG. 2B). The depth of the shaved strip can be minimal, generally between 0.01 to 0.02 mm or more. High luster diamond cut surface sections 12 and 12' are thus provided on only one side of the plates 10 and 10' which contrast with the rest of the surfaces 16 and 16' on the same side of the plates 10 and 10'. The unshaven sides 17 of the plates remain the same without deformation.

Figure 3A:
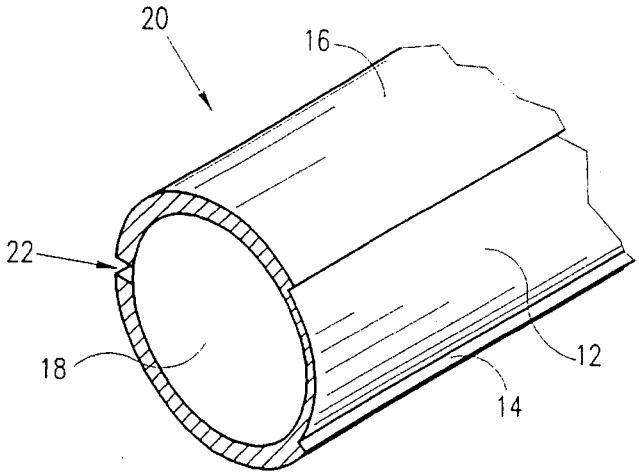
FIGS. 3A and 3B are enlarged perspective views of diamond cut hollow wire made from metal sheets of FIGS. 2A and 2B respectively.
Figure 3B:
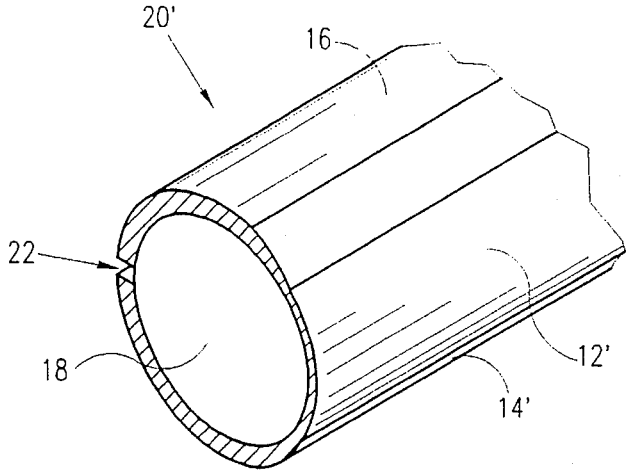
Figure 4:
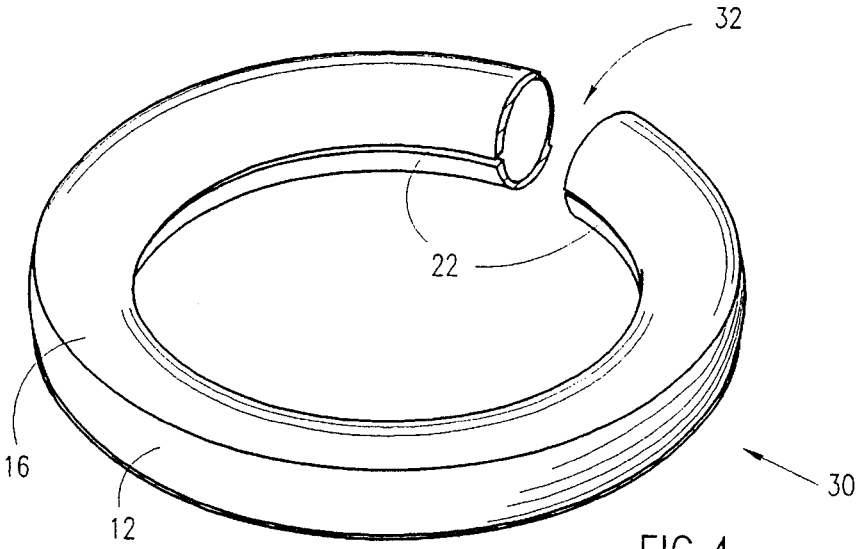
FIG. 4 is an enlarged view of a hollow chain link in accordance with a preferred embodiment of the invention.
Figure 5A:
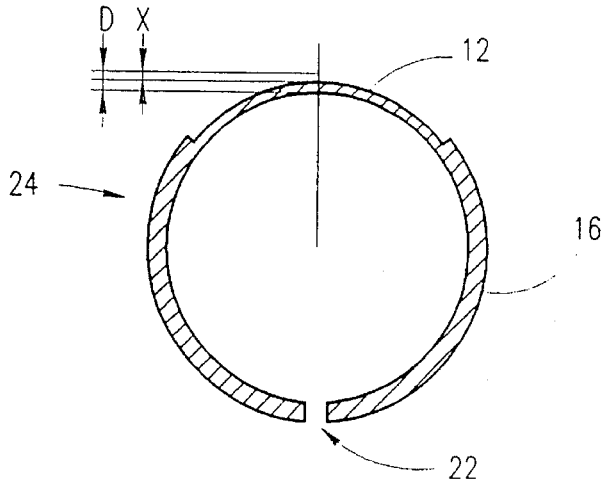
FIGS. 5A to 5E are enlarged cross-sectional views of link wires with shallow diamond cut bands or strips.
Figure 5B:
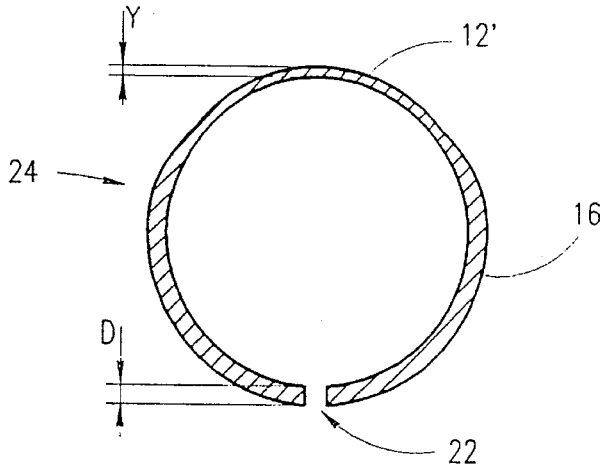
Figure 5C:
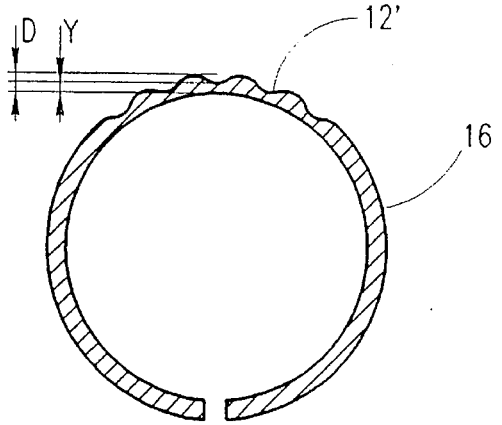
Figure 5D:
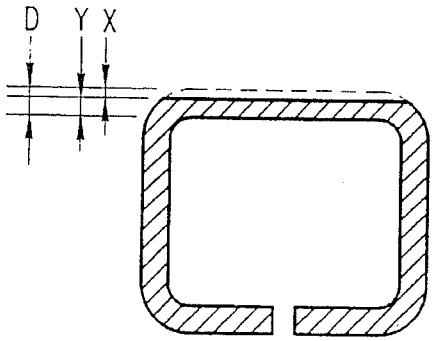
Figure 5E:
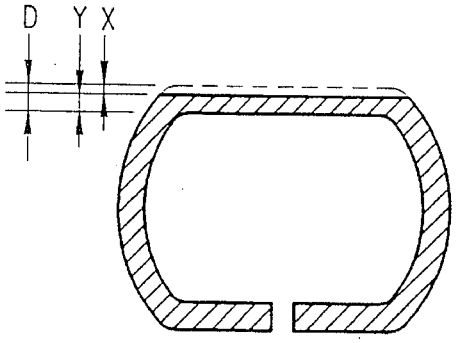

The metal sheets 10 and 10' are then drawn through a round die together with a soft metal wire core 18, to produce precious metal plated wires 20 and 20' (FIGS. 3A and 3B) with outer surface 16 and high luster diamond cut bands 12 and 12' respectively. The width of the sheets 10 and 10' are generally 15–20% smaller than the circumference of the soft metal core 18, thereby producing a gap 22 in the precious metal envelope covering the core 18 along the entire length of the drawn wire. The purpose of this gap 22 is to provide a large surface area for acid to come in contact with the soft metal core 18 and dissolve it, leaving a hollow precious metal wire. Chain links (FIG. 4) are prepared from the wires in a conventional manner by winding the wire into a coil and cutting the wire before each complete turn, forming a skewed link with a gap 32. The link is then unskewed for use in assembling a rope chain. The gap 32 is slightly larger than the outer diameter of the hollow wire forming link 30, so that one link can be fitted into another via the gap 32. The links are then immersed in an appropriate acid to dissolve the soft metal core 18 leaving a hollow chain link with a high luster shallow diamond cut surface band or strip on its outer perimeter. Alternatively, the links can be made into a chain and the chain placed in acid to dissolve the core.

FIGS. 5A to 5E show cross-sections of hollow link wires with different shallow diamond cut bands or strips. The wall section 16 of the wire, having a thickness D, is shaved by diamond cutting to a depth X, leaving a diamond cut surface of wire thickness Y. The inner circumference of the hollow wire is substantially the same throughout, irrespective of the diamond cut area on the outer wall surface.

The precious metal wire, both solid and hollow, used for this invention may have any geometric cross-section which will depend on the shape of the orifice in the die through which the precious metal wire is drawn. Such shapes may be round, oval, elongated, triangular, square, rectangular, hexagonal, rhombic, octagonal or irregular, as disclosed in my previous U.S. Pat. No. 4,996,835.

Figure 6:
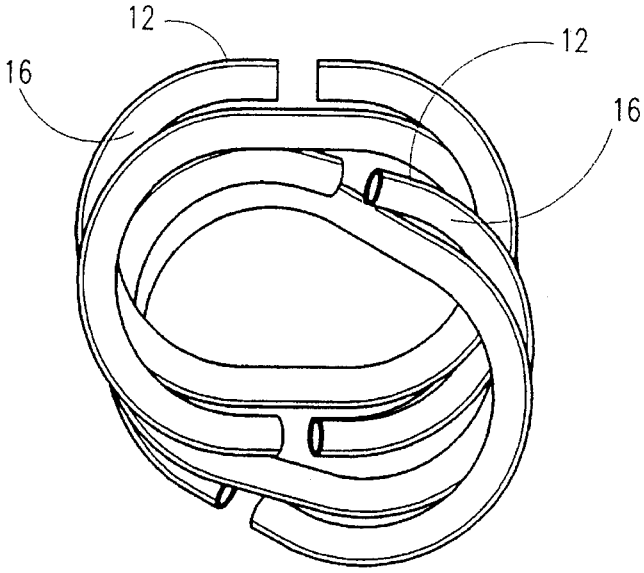
FIG. 6 illustrates a section of rope chain in accordance with preferred embodiments of the present invention made with elongated hollow chain links.

A rope chain is assembled with these links in a conventional manner by tightly intertwining the chain links one within the other and twisting them to produce a double helix rope chain. Such a rope chain is illustrated in FIG. 6, having a diamond cut strip 12 encompassing the entire outer perimeter of each link. The contrast in light reflectivity between the outer surface 16 of the link and the diamond cut strip 12 gives a sparkling effect to the chain comparable to a classical diamond cut rope chain. One advantage, of course, of the present invention is that it is easy to prepare diamond cut high luster hollow rope chains. These are considerably less expensive because of their lighter weight.

In accordance with this invention it is also possible to make diamond cut high luster rope chains with alternating rings, some having shaved diamond cut strips and others not, for example a chain with every second or third link having a sparkling diamond cut strip.

Figure 7A:
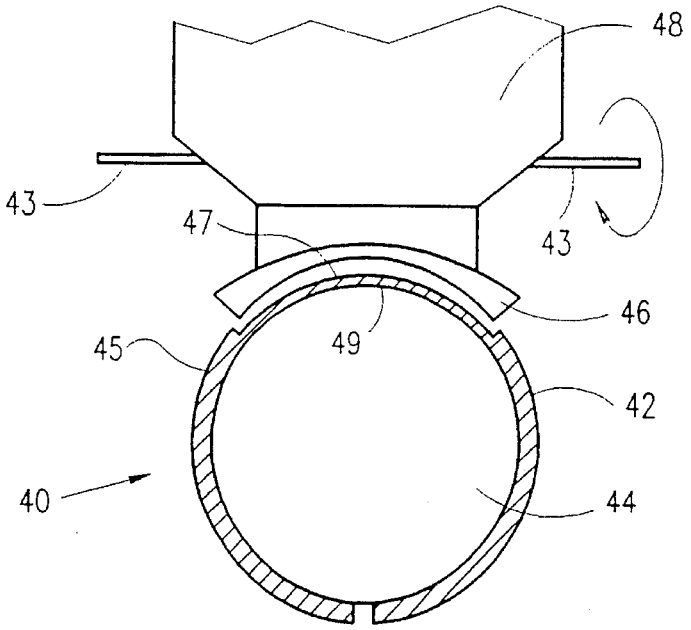
FIGS. 7A and 7B schematically illustrate a process for diamond cutting high luster surface bands or strips on precious metal wire according to another preferred embodiment of the invention.
Figure 7B:
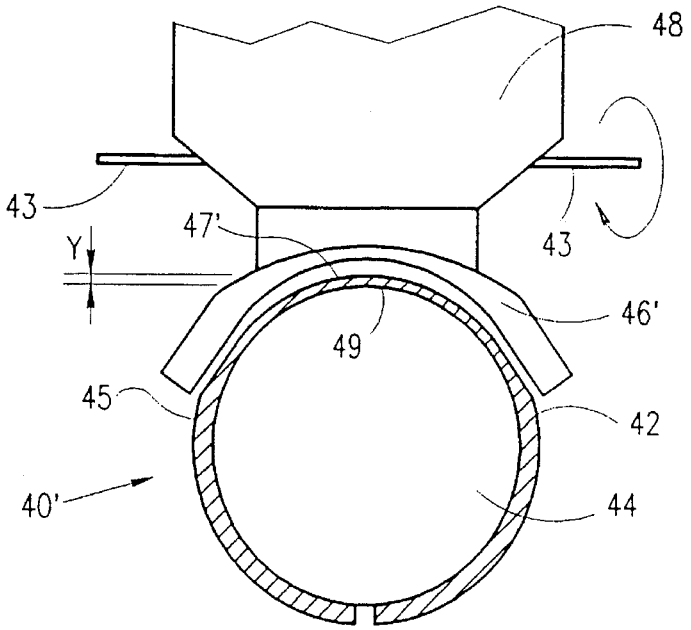

Referring now to FIGS. 7A and 7B, these schematically show alternative ways of preparing diamond cut bands or strips on precious metal wire in accordance with the invention. When the metal wires 40 and 40', shown here in cross-section, are still in the wire stage, prior to being formed into chain links, i.e. with the precious metal plating 42 covering a non-precious metal core 44, the wires 40 and 40' are pulled past curved diamond cutting edges 46 and 46' respectively mounted on cutting heads 48 and 48', which revolve around axis 43 at very high speed. The diamond cutting edges 46 and 46' are contoured in the shape of the surface 45 of the precious metal wire plate 42. The shallow shaved diamond cut surfaces 47 and 47', produced as the wires 40 and 40' are pulled past cutting edges 46 and 46', comprise a thin strips running along the length of outer surface of the the wires 40 and 40'. The inner hollow wall surface 49 is undistorted. The wires 40 and 40' can then be converted to chain links, each link having a shallow high luster diamond cut surface band or strip along its outer perimeter. By raising and lowering the cutting edges 46 and 46', sections of diamond cut strips can be shaved along the surface of the wire.

The diamond cutting edges for making shallow surface bands or strips can have any knife edge shape depending on the type of shallow band or strip one wishes to impart onto the outer surface of the chain link. The knife edge may be straight or curved, such as concave, convex or wavy. It may also be saw-toothed. The ultimate shape of the shallow diamond cut surface band or strip will be determined by the shape and length of the knife edge and the direction of movement between the knife edge and the wire or chain link.

Figure 8A:
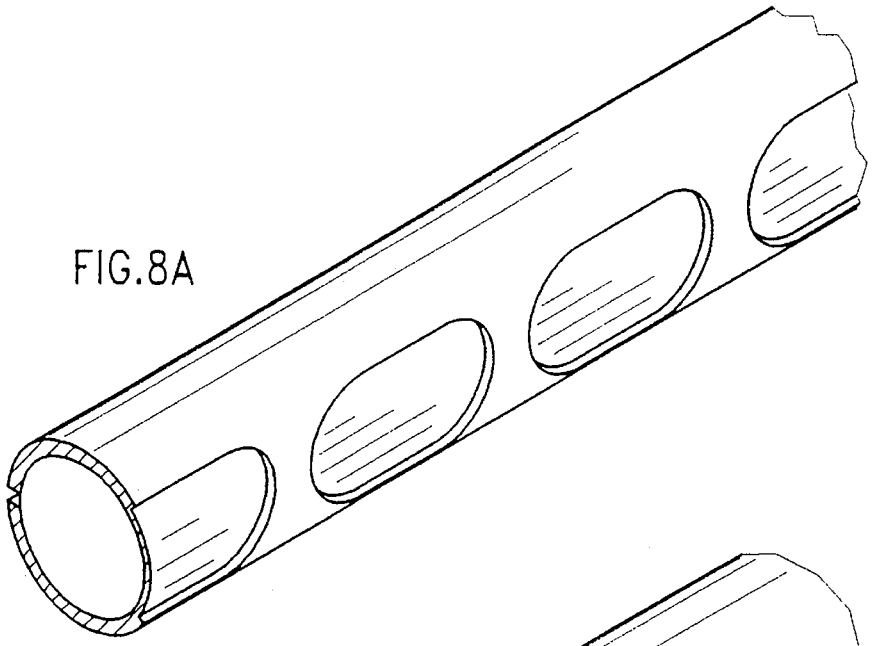
FIGS. 8A to 8C are perspective enlarged views of hollow wires with varying shaped high luster shallow diamond cut surface bands or strips from which chain links are made.
Figure 8B:
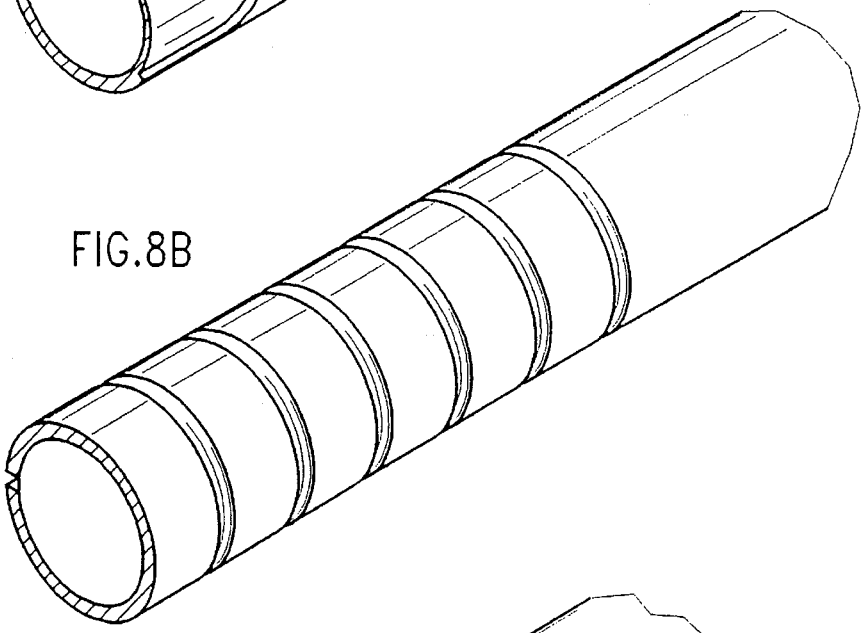
Figure 8C:
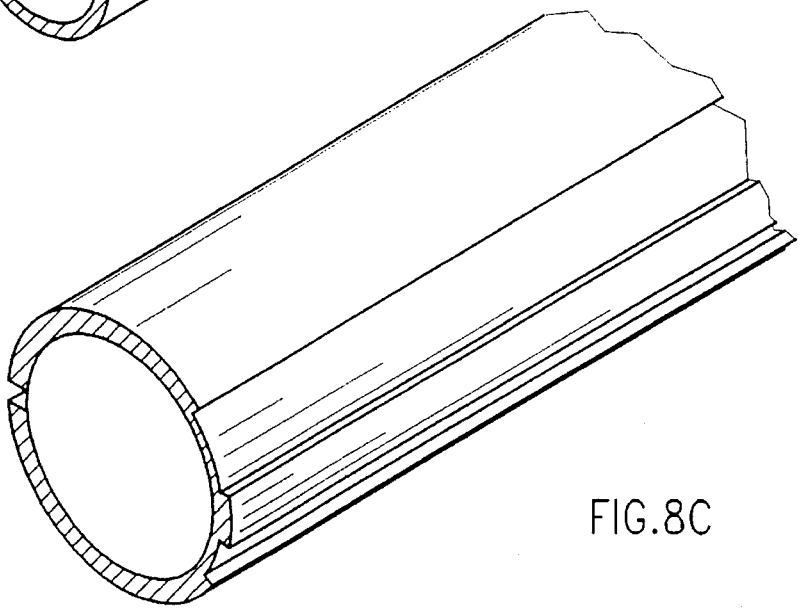
Figure 9:
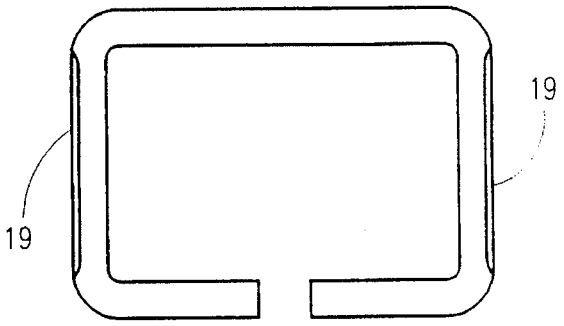
FIGS. 9–12 are planar views of some chain links having high luster shallow bands or strips on their outer surface without any deformation of the links.
Figure 10:
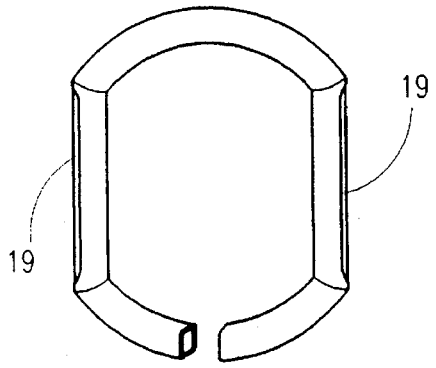
Figure 11:
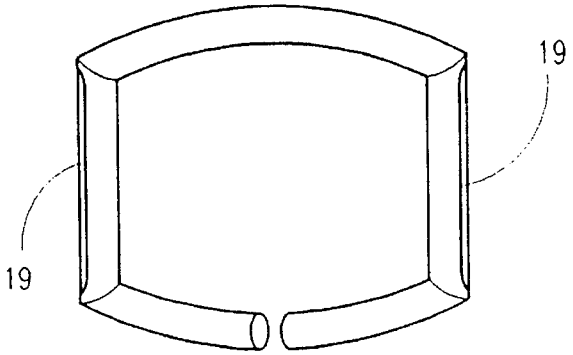
Figure 12:
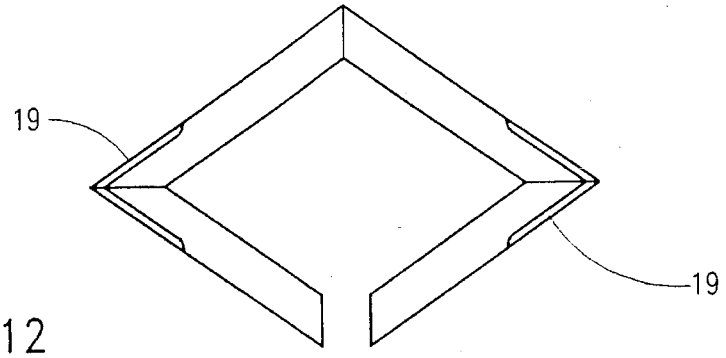

As stated earlier, the wire links of this invention may have the shallow diamond cut surface bands or strips on only part of the link surface, as shown in FIGS. 8A to 8C. The bands may be shapes other than linear, such as wavy (FIG. 5C), zigzag, toothed or star shaped. They may be parallel, radial or diagonal to the wire axis. Preferably, the diamond cut bands or strips 19 are located on one or both sides of the chain link, as illustrated in FIGS. 9–12 with respect to some non-circular links. This can be accomplished, inter alia, by diamond cutting the precious metal plate or wire surface discontinuously with short alternating intervals or by simultaneously moving the plate or wire under the diamond cutting edge laterally as well as longitudinally, or by using specialized diamond cutting edges. Similar or alternative methods can be applied to the straight or coiled wire.

It should be understood, of course, that the foregoing disclosure relates to only a preferred embodiment of the invention and that it is intended to cover all changes and modifications of the examples of the invention herein chosen for the purpose of the disclosure, which modifications do not constitute departures from the spirit and scope of the invention.

I claim:

1. A fine diamond cut rope chain comprising a double helix rope chain made from tightly interfitting links of precious metal link wire, each link having a small gap formed therein so as to enable one of said links to pass through the gap of another link, said links being intertwined to fit tightly one against another, at least some of the links of the chain having a shallow high luster diamond cut surface band formed in at least part of a peripheral outer wall surface of said link, the cross-section of the link wire being substantially of the same shape throughout.

2. A fine jewelry rope chain as in claim 1 wherein said chain links are hollow.

3. A fine jewelry rope chain as in claim 1 wherein said shallow high luster diamond cut surface band is curved to conform with at least part of a curvature of said peripheral outer wall surface.

4. A diamond cut rope chain as in claim 1 wherein all the links of the chain comprise diamond cut bands.

5. A diamond cut rope chain as in claim 1 wherein the diamond cut band is along the entire peripheral outer wall surface of the chain links.

6. A chain as in claim 1 wherein the diamond cut bands are located on a crest portion of the peripheral outer wall surface of the links of the rope chain.

7. A rope chain as in claim 1 wherein the shallow high luster surface band comprises a diamond cut of 0.001 mm to 0.04 mm in depth.

8. A rope chain as in claim 1 wherein the high luster surface band comprises a diamond cut of 0.01 mm to 0.03 mm in depth.

9. A chain link of precious metal for making jewelry rope chains comprising a shallow high luster diamond cut surface band formed in at least part of a peripheral outer wall surface of said link, the cross-section of said link being substantially of the same shape throughout.

10. A chain link as in claim 9 wherein said shallow high luster diamond cut surface band is curved to conform substantially with at least part of a curvature of the peripheral outer wall surface.

11. A chain link as in claim 9 wherein the diamond cut band extends along the entire length of the peripheral outer wall surface.

12. A chain link as in claim 9 which is hollow.

13. A chain link as in claim 9 wherein the diamond cut band extends transversely along the peripheral outer wall surface of the chain wire.

14. A chain link as in claim 9 wherein the diamond cut band is centrally located on either side of the gap.

15. A chain link as in claim 9 wherein the shallow high luster surface band comprises a diamond cut of 0.001 mm to 0.04 mm in depth.

16. A chain link as in claim 9 wherein the high luster surface band comprises a diamond cut of 0.01 mm to 0.03 mm in depth.

17. A method for manufacturing chain links having shallow high luster diamond cut surface bands on their perimeters, said chain links having a cross-section substantially the same throughout comprising:

a) shaving a precious metal plate with a high speed rotating diamond edge cutting tool to a depth of 0.001 to 0.04 mm to provide a high luster longitudinal band or strip, b) passing said plate together with a soft metal wire core through a die to make a precious metal plated wire having a high luster diamond cut band or strip along its outer length, and c) forming chain links from said precious metal plated wire containing a soft metal core.

18. A method for making a hollow rope chain comprising making chain links as in claim 17, intertwining the chain links into the shape of a rope chain, soldering the links together and removing the soft metal core from the links to produce a hollow chain.

19. A method for manufacturing chain links for making rope chains having high luster shallow diamond cut bands on at least a portion of their outer perimeter surface comprising contacting a precious metal wire with a high speed rotating diamond cutting edge providing relative motion between said wire and said cutting edge, to shave from the surface of said wire a shallow high luster surface band and subsequently forming said wire into chain links with said high luster surface band disposed on the outer circumference of said link.

20. A method as in claim 19 wherein said precious metal wire comprises a soft metal inner core, said core to be removed subsequent to forming the chain links, thereby providing hollow chain links.

21. A method as in claim 19 wherein the diamond cutting edge is shaped to conform with the curvature of at least part of the wire circumference.

22. A method as in claim 19 wherein the precious metal wire is in the form of a coil.

* * * * *